US008322765B2

(12) United States Patent
St. Germain

(10) Patent No.: US 8,322,765 B2
(45) Date of Patent: Dec. 4, 2012

(54) SYNTHETIC SLING WITH COMPONENT PARTS HAVING OPPOSING LAYS

(75) Inventor: George Frederick Dennis St. Germain, Chadds Ford, PA (US)

(73) Assignee: Slingmax, Inc., Aston, PA (US)

( * ) Notice: Subject to any disclaimer, the term of this patent is extended or adjusted under 35 U.S.C. 154(b) by 0 days.

(21) Appl. No.: 13/072,205

(22) Filed: Mar. 25, 2011

(65) Prior Publication Data

US 2011/0169285 A1 Jul. 14, 2011

Related U.S. Application Data

(63) Continuation of application No. 12/082,591, filed on Apr. 11, 2008, now Pat. No. 7,926,859, which is a continuation-in-part of application No. 11/981,110, filed on Oct. 31, 2007, now Pat. No. 7,568,333.

(51) Int. Cl.
*B66C 1/12* (2006.01)

(52) U.S. Cl. ..... 294/74; 57/231

(58) Field of Classification Search ..... 57/3, 6, 57/12, 13, 21, 201, 204, 224, 231; 294/74
See application file for complete search history.

(56) References Cited

U.S. PATENT DOCUMENTS

| | | | | | |
|---|---|---|---|---|---|
| 3,481,134 | A | * | 12/1969 | Whewell, Jr. | 57/12 |
| 3,899,206 | A | * | 8/1975 | Miura | 294/74 |
| 4,124,244 | A | * | 11/1978 | Bryant | 294/74 |
| 4,317,000 | A | * | 2/1982 | Ferer | 174/70 R |
| 4,354,704 | A | * | 10/1982 | Mayerjak | 294/74 |
| 4,724,668 | A | | 2/1988 | Wassenhoven | |
| 4,843,807 | A | * | 7/1989 | von Danwitz | 57/201 |
| 4,850,629 | A | | 7/1989 | St. Germain | |
| 5,333,442 | A | * | 8/1994 | Berger | 57/314 |
| 5,415,449 | A | * | 5/1995 | Kentner, Sr. | 294/74 |
| 5,649,414 | A | * | 7/1997 | Rawdon et al. | 57/201 |
| 7,127,878 | B1 | * | 10/2006 | Wilke et al. | 57/231 |
| 7,240,475 | B2 | * | 7/2007 | Smeets et al. | 57/201 |
| 7,926,859 | B2 | * | 4/2011 | St. Germain | 294/74 |
| 2006/0193576 | A1 | | 8/2006 | Lester et al. | |

FOREIGN PATENT DOCUMENTS

| | | | |
|---|---|---|---|
| DE | 27 16 056 | * | 10/1978 |
| EP | 0 281 287 | * | 9/1988 |
| GB | 1226531 | | 3/1971 |
| JP | 59125990 | * | 7/1984 |
| WO | WO93/14330 | | 7/1993 |

OTHER PUBLICATIONS

McKenna, H.A. Hearle, JWS, and O'Hear, N. "Handbook of fibre rope technology," published by Woodhead Publishing Limited, Cambridge, England, pp. 77-80 (2004).
Wire Rope Technical Board—Wire Rope Users Manual, Fourth Edition, p. 9, (2005).

* cited by examiner

*Primary Examiner* — Dean Kramer
(74) *Attorney, Agent, or Firm* — Stradley Ronon Stevens & Young, LLP

(57) ABSTRACT

A sling for industrial lifting comprising a cover having fibers twisted in a first direction; and a load-bearing core within the cover, the core having a helical twist of a plurality of core strands, each core strand twisted in a second direction.

18 Claims, 3 Drawing Sheets

SYNTHETIC SLING WITH COMPONENT PARTS HAVING OPPOSING LAYS

CROSS-REFERENCE TO RELATED APPLICATIONS

This application is a continuation of U.S. patent application Ser. No. 12/082,591 filed Apr. 11, 2008, which is a continuation-in-part and claims the benefit under any applicable U.S. statute to U.S. application Ser. No. 11/981,110 filed Oct. 31, 2007, now U.S. Pat. No. 7,568,333 that issued Aug. 4, 2009, the contents of which are incorporated in this application by reference.

FIELD OF THE INVENTION

The invention relates generally to industrial slings and, more particularly, to the relationship between the load-bearing core and protective covers for non-metal slings.

BACKGROUND OF THE INVENTION

Industrial slings used in rigging or to lift, load, tow and/or move heavy loads are well-known in the art. At one time, industrial slings were made exclusively of metal forming wire-rope or chains. Over the years, these industrial slings have become more flexible and stronger. However, despite these improvements, metal wire-rope slings still do not have the flexibility of non-metal (or synthetic) slings and have been largely replaced by non-metal slings.

Non-metal industrial slings may be made of natural or synthetic materials (especially those made of standard or high tenacity core yarns). Non-metal slings made of synthetic materials are usually called synthetic slings.

One advantage of synthetic slings is that they have a very high load-lifting performance (i.e., a high strength-to-weight ratio), which results in lighter, more flexible and even stronger slings than the heavier, relatively inflexible metal slings.

Synthetic slings typically have a load-bearing core inside an elongated, tubular cover. The core bears the entire weight of the load to be lifted while the cover's sole function is to protect the core from physical damage and environmental exposure.

The cover protects the entire length of the core from direct physical damage, such as sharp edges from the load and other objects that may come in contact with the sling. The cover also protects the core from molecular damage (e.g., chemicals/acids, ultraviolet degradation caused by sunlight, environmental pollutants, excessive heat under working conditions, etc.).

The load-bearing core of a synthetic sling is made of a number of core yarns (sometimes called core strands). Each core yarn is made of a plurality of threads. Some synthetic slings are made by winding the core yarns into an endless loop in which each run or loop of the core yarn is substantially parallel to every other loop (this may be referred to as load-bearing core having core yarns laid straight). The winding is usually performed on a machine having a motor-driven roller and a free-rolling roller set a specific distance away from the motor-driven roller. During the manufacturing process, the cover is "bunched" together in accordion-like fashion, and the core yarns are run straight through the cover. The distance between rollers is determined by the desired length of the sling to be made.

In manufacturing a sling, it is helpful to know how much weight the sling needs to support (i.e., the rated load) and how much force or weight each individual core yarn can support.

From that data, the number of loops that are needed to make the load-bearing core for the rated load may be calculated. Many factors may impact these calculations, including the type of material selected for the core yarns, the diameter of the yarns, and the diameter of the threads used to make the core yarns.

One problem with current synthetic slings is that there are loops of core yarns of slightly different lengths. When the sling is placed under load, the force of the load is borne by the shortest loops of core yarn. In other words, a load-bearing core is designed to have "X" number of core yarns to be able to lift the rated load, but only a fraction of the "X" number of core yarns bear the weight of the load because of the differences in lengths of each loop. This configuration sometimes results in the shortest loops being damaged and eventually breaking because they are overloaded. When the shortest loops of core yarns break, the next shortest loops of core yarns support the load until they too are damaged and eventually break, and so on until the synthetic sling suffers a catastrophic failure.

It is known in the art of wire-rope slings to twist the metal wires together. Various methods exist to force the wire's strands to twist together which include using a spinning wheel with holes where the individual wire stands are fed through. However, it has been shown that a similar method does not work with synthetic yarns because the synthetic yarns do not have the rigidity of the wire strands. Previous to this invention, there was no way to twist the synthetic core yarns together without special machinery and substantial input of time.

Therefore, it is desirable to provide synthetic slings with core yarns of more uniform length. It is also desirable to provide synthetic slings that are less susceptible to damage and breakage.

SUMMARY OF THE INVENTION

It is to be understood that both the foregoing general description and the following detailed description are exemplary, but are not restrictive, of the invention.

BRIEF DESCRIPTION OF THE DRAWINGS

The invention is best understood from the following detailed description when read in connection with the accompanying drawings. It is emphasized that, according to common practice, the various features of the drawings are not to scale. On the contrary, the dimensions of the various features are arbitrarily expanded or reduced for clarity. Included in the drawings are the following figures:

FIG. 3*a* illustrates a right regular lay;

FIG. 3*b* illustrates a left regular lay;

FIG. 3*c* illustrates a right lang lay;

FIG. 3*d* illustrates a left lang lay;

FIG. 3*e* illustrates a right alternate lay;

DETAILED DESCRIPTION OF THE PREFERRED EMBODIMENT

Figure 1:
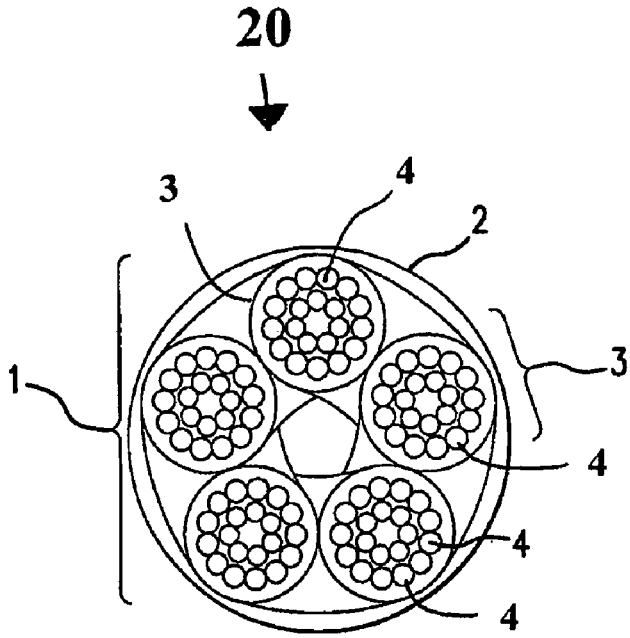
FIG. 1 is a cross-sectional view of a sling made in accordance with the invention.

The invention provides a synthetic sling having a helically-laid load-bearing core with a specific twist of core yarns that is relative to a cover manufactured from twisted fibers. A sling manufactured in accordance with the invention offers greater strength than a sling with a load-bearing core with no twist. In addition, this invention provides a method of manufacturing a sling that greatly reduces the time and expense of manufacturing. A sling made in accordance with this invention has significantly more strength than a sling made from conventional methods using the same amount of material; this allows either a stronger sling or a sling of the same strength with less material than conventional slings.

The synthetic sling has a cover made of a plurality of fibers and, preferably, synthetic fibers. The cover may be made as an elongated tube with ends sewn together after the load-bearing core is formed.

The synthetic, or non-metal, sling also has a core that bears the weight of the load to be lifted and a cover that protects the load-bearing core. The core is preferably made of a plurality core yarns, or strands, of synthetic material. Each core yarn is made up of a plurality of threads.

The individual core strands may be made of one or more synthetic materials, including high molecular weight polyethylene, high modulus polyethylenes (HMPE), high performance polyethylenes (HPPE), aromatic polyesters (e.g., liquid crystal polymers (LCP)), and para-aramids (e.g., Kevlar®). The core strands may also be made from other types of synthetics or a combination of synthetic materials. The cover may be made of a nylon or other synthetic fiber. However, the invention is not limited to specific materials. Other possible materials of which the core strand could be made include: synthetic fibers, natural fibers, metallic fibers, a combination of synthetic and metallic fibers, a combination of synthetic and natural fibers, or a combination of all three fibers.

One machine used to make synthetic slings involves feeding a plurality of core yarns into a cover. The machines may hold the cover in a "bunched up" or accordion-like fashion such that it forms a straight tube and force the core yarns through the cover. The bunched cover does not touch either the motor-driven roller or the free-spinning tail roller. Once the desired number of loops of core yarns are run through the cover, the ends of the yarns are spliced together and the cover is "unbunched" to encase the entire ring of the load-bearing core. This type of machine is sometimes referred to as the "European" machine.

Another machine to manufacture slings is disclosed in U.S. Pat. No. 7,568,333, which is hereby incorporated by reference as if fully set forth herein. The cover is almost completely extended in an oval shape (i.e., the cover is not bunched together) and the core yarns are run through the entire length of the cover.

Any process known in the art may be used to make the cover. The material used for the fibers is chosen based on the type of environment in which the sling will be used. For example, if the sling will be used in an environment having high temperatures (e.g., an iron smelting plant), the material used for the fibers to make the cover will have to withstand high temperatures and if the sling will be used in a chemical plant that makes acids, the material will have to withstand exposure to those acids. Similarly, a sling that is used on an off-shore oil platform will have a cover made from fibers that can withstand ultraviolet rays and salt water.

The core yarns may be fed through the cover without bunching the cover in an accordion-like fashion; also, it is preferred to lock the roller opposite the motor-driven-roller preventing it from rotating (or even eliminate the tail roller all together).

The load-bearing core bears the entire load when the sling is used to lift, move or tow an object. No weight is supported by the cover.

One design of synthetic slings is a roundsling that has a load-bearing core formed from a plurality of core yarns configured in a continuous loop (in a substantially parallel configuration) resulting in a sling that has a circular or oval-shaped appearance. The load-bearing core forms a substantially "endless" loop in which the ends of a cover are sewn together to form a ring (and is usually referred to as an endless cover).

Roundslings may be used in a broad variety of heavy load-lifting applications that range from ordinary construction, plant and equipment operations, to ship building (e.g., oil rigs) and nuclear power plants. The lifting core fibers of roundslings may be derived from natural or synthetic materials, such as polyester, polyethylene, and nylon.

When an individual core yarn is made, the threads may be twisted together in a left-lay (called an "S" twist) or a right-lay (called a "Z" twist), or they may not be twisted.

A load-bearing core made from core yarns twisted together offers greater strength than a load-bearing core made from yarns that are not twisted together.

The core yarns may be twisted together by inserting a plurality of core yarns, each made from threads twisted in one direction, into a cover made from fibers with a twist in the opposite direction. As the core yarns are inserted into the cover, the interaction between the opposing twist directions results in the core yarns twisting in a helically-laid bundle.

When the core yarns are formed with threads twisted in one lay/direction (e.g., an S twist), and the cover is woven in the opposite lay/direction (e.g., a Z twist), and the core yarns are forced into the cover during a winding step of the manufacturing process, the friction between the plurality of core yarns rubbing against the inside of the cover forces the loops of core yarns to twist about each other forming a helically-laid strand.

Twisting the loops of core yarns in a helical pattern results in a 12-15% increase in strength of the load-bearing core. In other words, with no other changes other than twisting the load-bearing core yarns, a sling achieves a significant increase in the weight of the load the sling can lift. Alternatively, 12-15% less core yarns may be used to make a sling having the same load rating as a sling with substantially parallel or untwisted loops of core yarns.

The cover of the sling may be woven from fibers in a left-lay, right-lay or with no lay. However, almost all covers are manufactured with either a right-lay or a left-lay.

When the plurality of core yarns having a specific lay are pulled through the cover having the opposing lay, the friction of the core yarns moving past the cover results in the core yarns twisting about each other during the formation of the load-bearing core. The loops of core yarns form a helically-laid load-bearing core. The resulting synthetic sling is capable of bearing more weight than other slings that do not have twisted load-bearing core yarns.

Accordingly, a synthetic sling made according to the subject disclosure with the same amount of core yarns will be stronger than a sling that does not use twisted core yarns. Alternatively, a sling made according to the subject disclosure can be made from less material to produce a sling with the same load-bearing rating as a sling that does not have helically-twisted core yarns.

Referring to FIG. 1, a synthetic sling 20 is comprised primarily of a load-bearing core 1 and an outer cover 2. The load-bearing core 1 is encased by the cover 2, which runs the length of the sling 20. The cover 2 protects the load-bearing core 1 from abrasion and from environmental conditions (e.g., exposure to acid, exposure to sunlight, or exposure to ultraviolet radiation, etc.). The load-bearing core 1 is comprised of a plurality of core yarns 3. Each core yarn, or core strand, 3 is made of a plurality of threads 4.

Figure 2:
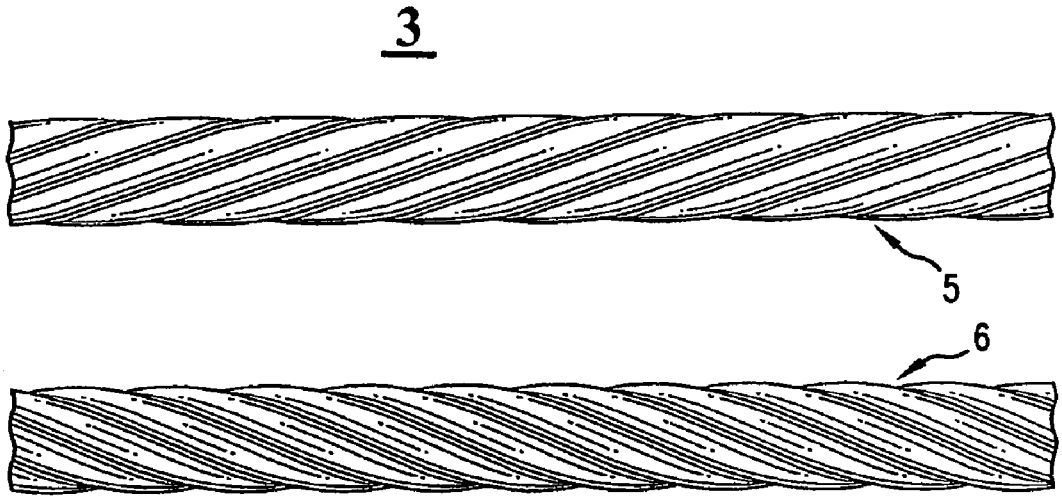
FIG. 2 is an enlarged view of individual core strands having a left-lay (i.e., an "S" twist) and a right-lay (i.e., a "Z" twist)

Referring now to FIGS. 2 and 3, the invention involves different parts of the sling 20, each having a twist. First, a single core yarn 3 can be made from individual threads 4 having a left-lay ("S" twist or S lay) 5 or right-lay ("Z" twist or Z lay) 6. Preferably, the individual core yarn comprises an S twist. Second, the fibers used to weave the cover can have three possible configurations, an S twist, Z twist, or no twist.

One feature of this invention is that the core yarns 3 have the opposite lay when compared to the fibers used to weave the cover 2. The interaction of the core yarns 3 with the inner side of the cover 2 during the manufacturing process causes the resulting load-bearing core 1 to form in a helically-laid bundle. The lay of the load-bearing core 1 depends on the lay of the core yarns 3 and the lay of the fibers of the cover 2. In a preferred embodiment, the core yarns 3 have an S twist and the fibers in the cover 2 have a Z twist; this configuration results in a sling with a load-bearing core having an S twist.

In another embodiment of this invention, the core yarns 3 have a Z twist and the fibers in the cover 2 have an S twist; this configuration results in a sling with a load-bearing core having a Z twist.

Figure 3A:
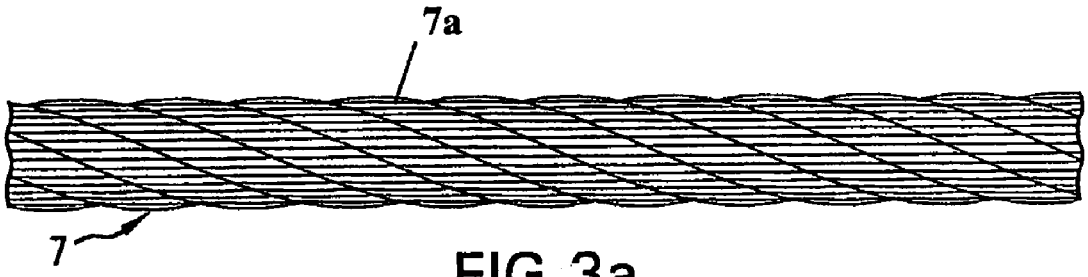
FIGS. 3*a*-3*e* illustrate variations of typical wire rope lays.
Figure 3B:
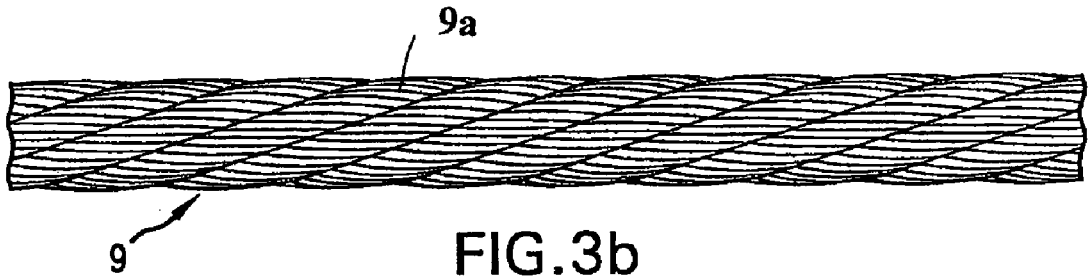
Figure 3C:
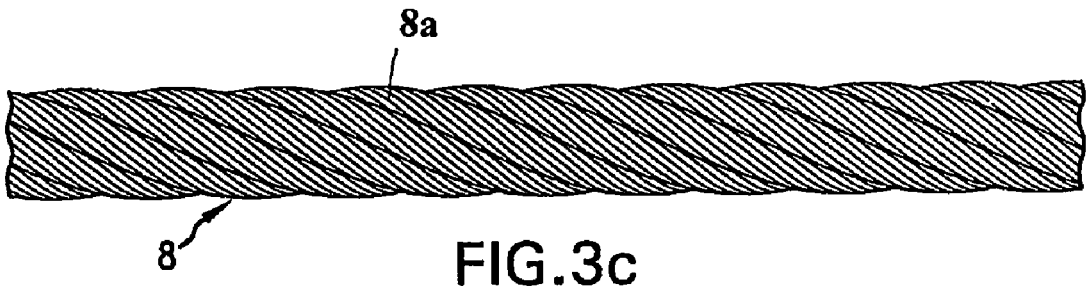
Figure 3D:
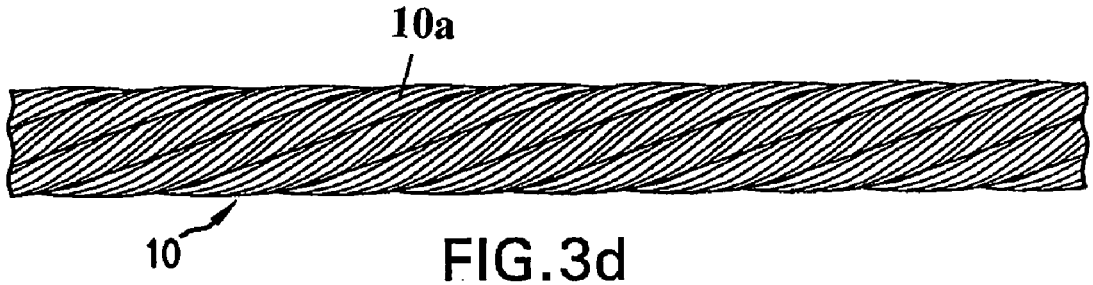

FIGS. 3*a* and 3*c* show a right lay rope 7 and 8, respectively. Conversely, FIGS. 3*b* and 3*d* show a left lay rope 9 and 10, respectively. FIGS. 3*a* and 3*b* show regular lay ropes 7 and 9, respectively. Following these are the types known as lang lay ropes 8 and 10 shown in FIGS. 3*c* and 3*d*. Note that the wires in regular lay ropes 7 and 9 appear to line up with the axis of the rope; in lang lay ropes 8 and 10, the wires form an angle with the axis of the rope. This difference in appearance is a result of variations in manufacturing techniques: regular lay ropes 7 and 9 are made so that the direction of the wire lay in the strand 7*a* and 9*a* is opposite to the direction of the strand lay in the rope 7 and 9; lang lay ropes 8 and 10 are made with both strand lay and rope lay in the same direction, as shown with the strands 8*a* and 10*a*.

Figure 3E:
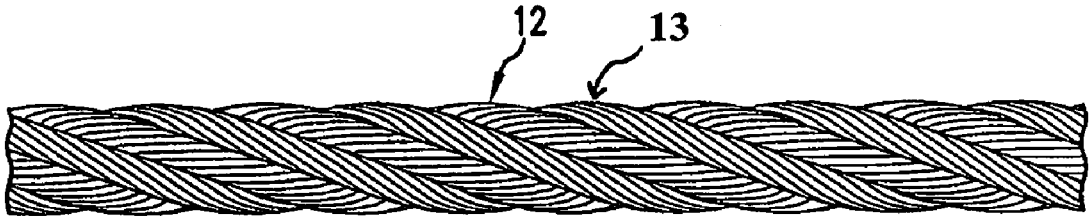

Finally, FIG. 3*e* shows an "alternate lay" that consists of alternating right and left lay strands 12 and 13. The non-metal equivalent is to have that stands 12 and 13 of the load-bearing core 1 twisted together in an S twist (strand 12) alternating with immediately adjacent individual core strands 13 having a Z twist. By using the alternate lay configuration for the core strands 12 and 13, the core strands 12 and 13 interact with a cover 2 that has either an S twist or a Z twist.

Core strands that are twisted together can bear heavier loads than core strands that are not twisted. The invention is not limited to any specific rate of twisting of either the individual core yarns, the helically-shaped load-bearing core, or the cover. Any number of revolutions per unit of length (e.g., twists per foot) is encompassed in this invention.

The core strands twisted together and the cover may have a rate of twisting that is about the same. However, the invention envisions a sling where the core yarns twisted together have more revolutions than the cover. The invention also envisions a sling where the core yarns twisted together have less revolutions than the cover.

Figure 4:
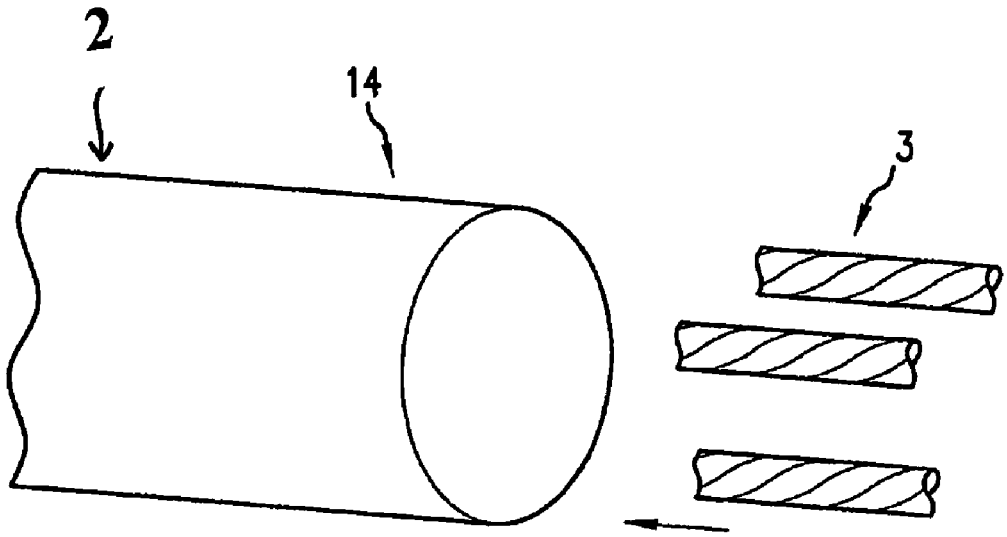
FIG. 4 is an illustration of the core strands being inserted into a cover.
Figure 5:
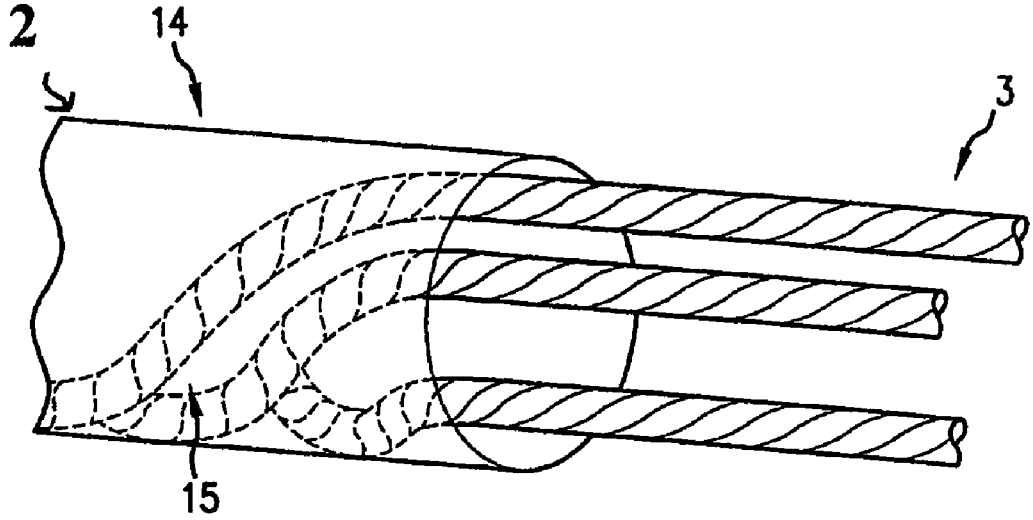
FIG. 5 is an illustration of several core strands twisting by interacting with the cover.

The invention uses the interaction between the core yarns used to make the load-bearing core and the cover to twist the core strands together--and with an appropriate amount of twist per foot. In its manufacture, the number of twists per foot of the helically-shaped loading-bearing core may be adjusted by changing the rate at which the core yarns are fed into the cover, the diameter of the cover (which changes the amount of friction between the core yarns and the interior of the cover), the number of core yarns used to manufacture the load-bearing core, and the thickness of the threads used to make the individual core yarns, or making other modifications. Specifically, with regard to FIGS. 4 and 5, core strands 3 with a lay in one direction are inserted into a cover 2 woven from fibers 14 with a lay in the opposing direction. Before being inserted, the core strands 3 are substantially parallel to each other as illustrated in FIG. 4. As the core strands 3 are pulled into the cover, the directional twist of the cover 2 interacts with the twist of the individual core strands 3. This interaction is caused by the friction of the opposing directional twists against each other. This interaction results in the core yarns 3 twisting about each other, and the resulting twist is in the same direction as the individual core strands 15. It is believed that the step of inserting the core strands 3 into the cover 2 forcing the core strands 3 to twist together is similar to how a grooved interior of a gun barrel forces a bullet to twist. Accordingly, the apparatus may be referred to as a "rifled" cover.

A feature of this invention is that the interaction of the twist of the cover 2 and the twist of the individual core strands 3 causes the core strands 3 to twist together in a specific manner to form the helically-laid load-bearing core 1 of the sling; no other force needs to be exerted on the core strands 3 during the sling manufacturing process other than the friction created when the core strands 3 are fed into the cover 2 during the making of the load-bearing core 1.

While the invention has been described in detail and with reference to specific embodiments thereof, it will be apparent to one skilled in the art that various changes and modifications can be made therein without departing from the spirit and scope thereof Thus, it is intended that the invention covers the modifications and variations of this invention provided they come within the scope of the appended claims and their equivalents.

What is claimed is:

1. A synthetic sling comprising:

a cover having fibers twisted in only a first direction; and a load-bearing core within the cover, wherein the load-bearing core is made from a plurality of core strands having a helical twist, wherein the core strands are twisted in a second direction, the first direction of the cover having an opposite lay from the second direction of the core strands.

2. The sling of claim 1 wherein the second direction comprises a Z direction and first direction comprises an S direction, resulting in the helical twist of the load-bearing core in the Z direction.

3. The sling of claim 1 wherein the second direction comprises an S direction and the first direction comprises a Z direction, resulting in the helical twist of the load-bearing core in the S direction.

4. The sling of claim 1 wherein the helical twist of the core strands is caused by an interaction of the twist of each core strand and the twist of the fibers that form the cover.

5. The sling of claim 1 where the twisting of the core strands twisted together was caused by friction between the directional twist of each core strand and an opposing directional twist of the fibers that are used to make the cover.

6. The sling of claim 1 wherein the core strands comprise at least one synthetic material.

7. The sling of claim 1 wherein the core strands comprise at least one of a high molecular weight polyethylene, high modulus polyethylenes (HMPE), high performance polyethylenes (HPPE), aromatic polyesters, liquid crystal polymers (LCP), and para-aramids.

8. The sling of claim 1 wherein the core strands comprise at least one of synthetic fibers, natural fibers, and metallic fibers.

9. The sling of claim 1 wherein the sling comprises a roundsling.

10. The sling of claim 1 wherein the core strands comprise at least one of a right lay and a left lay and at least one of a regular lay and a lang lay.

11. A non-metal sling comprising:

a load-bearing core, wherein the load-bearing core is made from a plurality of core yarns having a helical twist wherein each core yarn is made from a plurality of threads wherein the threads are twisted in a second direction; and a cover that encapsulates the load-bearing core, the cover having twisted fibers twisted in only a first direction, the first direction of the cover having an opposite lay from the second direction of the threads.

12. The sling of claim 11 wherein about half of the core yarns comprise an S lay and the remaining core yarns comprise a Z lay.

13. The sling of claim 11 wherein the cover comprises a plurality of fibers, the fibers having a Z lay and the core yarns having an S lay.

14. The sling of claim 11 wherein the fibers of the cover comprise an S lay and the core yarns comprise a Z lay.

15. The sling of claim 11 wherein the core yarns comprise at least one of a right lay and a left lay and at least one of a regular lay and a lang lay.

16. The sling of claim 11 wherein the core yarns comprise synthetic threads.

17. The sling of claim 11 wherein the load-bearing core comprises a substantially endless loop in which ends of the cover form a ring.

18. The sling of claim 11 wherein the core strands comprise at least one synthetic material.

* * * * *